US007042419B2

(12) United States Patent
Werner et al.

(10) Patent No.: US 7,042,419 B2
(45) Date of Patent: May 9, 2006

(54) HIGH-SELECTIVITY ELECTROMAGNETIC BANDGAP DEVICE AND ANTENNA SYSTEM

(75) Inventors: Douglas H. Werner, State College, PA (US); Pingjuan L. Werner, State College, PA (US); Michael J. Wilhelm, Stillwater, OK (US)

(73) Assignee: The Penn State Reserach Foundation, University Park, PA (US)

( * ) Notice: Subject to any disclaimer, the term of this patent is extended or adjusted under 35 U.S.C. 154(b) by 0 days.

(21) Appl. No.: 10/909,213

(22) Filed: Jul. 30, 2004

(65) Prior Publication Data

US 2006/0017651 A1 Jan. 26, 2006

Related U.S. Application Data

(60) Provisional application No. 60/491,922, filed on Aug. 1, 2003.

(51) Int. Cl.
*H01Q 15/02* (2006.01)

(52) U.S. Cl. ..... 343/909

(58) Field of Classification Search ..... 343/909
See application file for complete search history.

(56) References Cited

U.S. PATENT DOCUMENTS

| | | | | |
|---|---|---|---|---|
| 5,208,603 | A | 5/1993 | Yee | |
| 5,917,458 | A | 6/1999 | Ho et al. | |
| 6,323,826 | B1 | 11/2001 | Sievenpiper et al. | |
| 6,426,722 | B1 | 7/2002 | Sievenpiper et al. | |
| 6,483,480 | B1 | 11/2002 | Sievenpiper et al. | |
| 6,538,621 | B1 | 3/2003 | Sievenpiper et al. | |
| 6,545,647 | B1 | 4/2003 | Sievenpiper et al. | |
| 6,768,476 | B1 | 7/2004 | Lilly et al. | |
| 6,774,867 | B1 * | 8/2004 | Diaz et al. | 343/909 |
| 6,917,343 | B1 * | 7/2005 | Sanchez et al. | 343/795 |

* cited by examiner

*Primary Examiner*—Tho Phan
(74) *Attorney, Agent, or Firm*—McKee, Voorhees & Sease, P.L.C.

(57) ABSTRACT

An antenna system includes an antenna element and an electromagnetic bandgap element proximate the antenna element wherein the electromagnetic bandgap element is optimized for narrow bandwidth operation thereby providing radiofrequency selectivity to the antenna system. Preferably the electromagnetic bandgap element is tunable such as through use of a bias-alterable dielectric substrate or other tuning mechanism. The design approach also provides a means of creating an ultra-thin low-profile narrowband tunable channel selective antenna system suitable for low frequency applications.

28 Claims, 6 Drawing Sheets

HIGH-SELECTIVITY ELECTROMAGNETIC BANDGAP DEVICE AND ANTENNA SYSTEM

PRIORITY STATEMENT

This application is a conversion of and claims priority to U.S. Provisional Patent Application No. 60/491,922, filed on Aug. 1, 2003, herein incorporated by reference in its entirety.

GRANT REFERENCE

Work for this invention was funded by grants from the Department of Defense Advanced Research Projects Agency Contract No. NBCHC010061. The United States government may have certain rights in this invention.

BACKGROUND OF THE INVENTION

The present invention addresses problems in several areas which are seemingly unrelated without having the benefit of the disclosure concerning the present invention. A first area of the disclosure is the general area of frequency tunable antennas. Frequency tunable antennas are known to exist but such antennas do not provide a narrow bandwidth of operation. Moreover such frequency tunable antennas do not provide for system selectivity.

In typical communication systems, many communications channels are present. Each channel has a bandwidth commensurate with a single line of communication, whether it be digital data, voice, or other exchange of information. For example, channels for low baud rate narrowband FM signals typically employ bandwidths of 6.25 kHz, 12.5 kHz, or 25 kHz. Television channels typically occupy channel bandwidths of over 6 MHz. The size of the channel is application specific. It is important to point out that the antenna used in these systems will almost always have a bandwidth that is wide enough for a large portion of, if not at all, available channels to be received without retuning the antenna. For example, a dipole antenna typically has a useful bandwidth of about 10%. Although an antenna engineer would consider this to be a narrowband antenna, a communications engineer may consider it to be a wideband antenna if it allows most or all of the available channels of a specific system to be received, as the antenna imparts little if any channel selectivity to the overall receiver system.

The present invention also relates to electromagnetic bandgap (EBG) Artificial Magnetic Conducting (AMC) surfaces. AMC surfaces are also referred to as perfect magnetic conductor (PMC) surfaces and as high-impedance surfaces. When designing an EBG AMC ground plane, there exist certain intrinsic tradeoffs related to the frequency response and size of the structure. For example, when using a single-layer Frequency Selective Surface (FSS) mounted above a substrate backed with a Perfect Electrical Conductor (PEC) ground plane, the bandwidth of the resulting structure is strongly dependent upon the substrate thickness and effective dielectric permittivity. By increasing the substrate thickness with respect to wavelength, bandwidth can be increased. Also, by decreasing the relative dielectric constant of the substrate, the bandwidth can be further improved. Hence, the conventional approach for designing a broadband AMC surface has been to use a relatively thick substrate with a permittivity as close as possible to that of free space.

Such a structure is relatively straightforward to design and construct for operating frequencies above 1 GHz. This is due to the fact that at higher frequencies, a thick substrate in terms of wavelength can still be physically thin. This allows for a reasonable bandwidth on the order of 5 to 20% to be achieved with a physically thin structure. However, designing such a structure can become quite challenging for low frequency applications, specifically below 1 GHz. This is mainly because the substrate dimensions needed to achieve reasonable bandwidths of at least 5% or more are much too thick for most practical purposes. It is for this reason that EBG AMC structures are generally disregarded for low frequency applications.

Thus, problems remain with the use of EBG AMC structures and particularly to the low frequency application of EBG AMC surfaces as well as with frequency tunable antennas generally. Therefore, it is a primary object, feature, or advantage of the present invention to improve upon the state of the art.

It is a further object, feature, or advantage of the present invention to enable creation of an antenna system possessing generally narrow bandwidths such that the antenna system will screen out adjacent signals thereby providing radio system selectivity.

Yet another object, feature, or advantage of the present invention is to add tunability to an EBG to give overall antenna system frequency agility.

A still further object, feature, or advantage of the present invention is to create an ultra-thin EBG AMC structure with a high-k substrate material that operates effectively well below 1 GHz.

A still further object, feature, or advantage of the present invention is to use an ultra-thin EBG AMC structure with a high-k substrate material that operates effectively well below 1 GHz as the basis for creating a low-profile tunable narrowband (i.e., channel selective) antenna system.

Yet another object of the present invention is that it provides for limiting the bandwidth of an antenna such that it allows only one channel or a select group of adjacent channels through the antenna at any one time such that the antenna can be said to be narrowband and frequency selective with the antenna system adding frequency selectivity to an overall receiver system.

One or more of these and/or other objects, features, or advantages of the present invention will be apparent from the specification and claims that follow. The present invention is in no way limited by the background of the invention provided herein.

SUMMARY OF THE INVENTION

The present invention, through use of an EBG provides an antenna system possessing generally narrow bandwidths such that the antenna system will screen out adjacent signals, providing radio system selectivity. In addition to this selectivity, tunability is preferably added to the EBG in order to provide the overall antenna system with frequency agility.

The present invention achieves considerable operating frequency range at low frequencies, specifically below 1 GHz, by the use of an ultra-thin tunable Electromagnetic Bandgap (EBG) Artificial Magnetic Conducting (AMC) surface. By incorporating a high dielectric, ultra-thin substrate into the design of an EBG AMC surface, it is now possible to achieve a narrow instantaneous bandwidth of operation. However, by utilizing a tunable surface, the center frequency of this narrow bandwidth may be made agile and capable of being adjusted. The narrow bandwidth of the structure gives rise to a "channel" frequency determined by the sharp resonance of the AMC surface. By actively tuning the dielectric substrate and hence the overall capacitance of the surface, this resonant frequency can be shifted between channels to cover a reasonably wide bandwidth. Thus, the same operating frequency range as found in a much thicker structure AMC can be achieved by tuning the thinner narrowband AMC accordingly. This design approach of the present invention is especially useful at low frequencies below 1 GHz, where the overall thickness of conventional AMC surfaces becomes an issue of practical limitation. However, the present invention provides for ultra-thin tunable EBG AMC surfaces that have an overall thickness less than about $\lambda/2000$.

According to one aspect of the present invention an antenna system is disclosed. The antenna system includes an antenna element and an EBG element proximate the antenna element. The EBG element is optimized for narrow bandwidth operation thereby providing radiofrequency selectivity. Preferably, the EBG element is tunable, such as through the application of bias to the EBG to change the dielectric constant of a substrate of the EBG element. It is preferred that the operation frequency is less than about 1 GHz and preferably substantially less than 1 GHz.

According to another aspect of the present invention, an EBG AMC surface for use in an antenna system is disclosed that provides a narrow bandwidth of operation and radio frequency selectivity. The EBG AMC surface includes a substrate having a high dielectric constant, such as a dielectric constant of about 40 or higher. The substrate has a thickness of less than about $\lambda/100$ or less where the operating frequency given by $c/\lambda$ where c is the speed of light, is less than about 1 GHz and preferably substantially less than 1 GHz. The substrate is patterned with conductive patches to form a mosaic. The mosaic is preferably covered with a thin high-resistivity coating for the application of bias. Also it is preferred that the substrate is tunable such as through a bias-alterable dielectric constant.

According to another aspect of the present invention, an antenna system includes an antenna element and an electromagnetic bandgap element proximate the antenna element. The electromagnetic bandgap element includes a substrate of a dielectric material patterned with conductive patches to provide a unit cell geometry suitable for narrow bandwidth operation of less than about 5 percent of an operating frequency to thereby provide radiofrequency selectivity. The operating frequency is less than about 1 GHz. Preferably the electromagnetic bandgap element is tunable.

DETAILED DESCRIPTION OF THE PREFERRED EMBODIMENT

Figure 4:
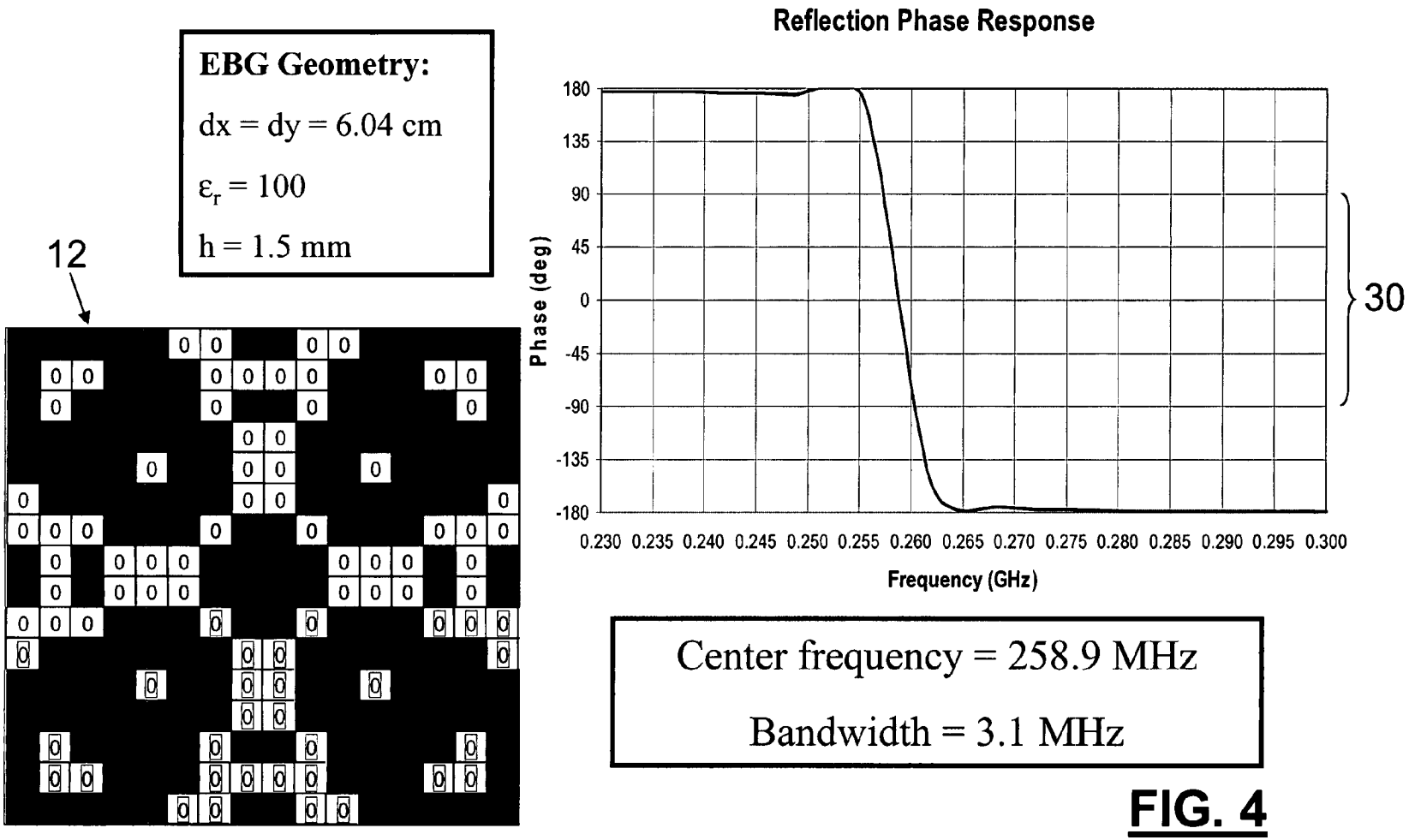
FIG. 4 is a graphical representation of one embodiment of an EBG according to the present invention that illustrates bandwidth, frequency, and geometry characteristics.

EBG materials display a reflection phase versus frequency such as that illustrated in FIG. 4. The center frequency of operation is defined as that frequency where the reflection phase is zero. This point on the frequency response curve is very unique. A consequence of zero-phase reflection is that the electric field is not flipped in polarity as is the case for all other electrical conductors (which may be considered perfect electrical conductors (PECs)), but is in fact reflected without a phase shift. This is a unique property that is provided by the operation of these resonant surfaces. In practice, the bandwidth of operation is defined as the frequency range where the reflection phase is between −90 degrees and 90 degrees.

With this unique property, antennas can be placed proximate (on or near) these surfaces without experiencing the short-circuiting effects associated with PEC ground planes. As the operating frequency with which the antenna is being driven leaves the band of operation defined by a −90 to 90 degree reflection phase, the in-phase reflection property is lost and PEC behavior returns, short-circuiting the antenna and quenching antenna operation.

The present invention provides a narrowband EBG and an antenna configured such that the EBG provides overall RF selectivity. The EBG operates in a manner typical of all EBGs except that the EBG has been optimized for narrow bandwidths. The out-of-band quenching characteristics of this narrowband EBG negate antenna system gain off resonance thereby creating an antenna system with an overall narrow bandwidth. In most all RF systems, system bandwidth will always be the same as or less than that of the device within the system with the least bandwidth. An antenna system of the present invention utilizes this principal such that the bandwidth of the antenna system of the present invention will be the same or less than that of the EBG device it is mounted on.

The present invention not only includes a singleband narrowband antenna system with improved selectivity, but also a system that is frequency agile. Because the EBG can be frequency agile, the antenna system as a whole becomes frequency agile. One way of achieving this frequency agility in the EBG is through incorporating a bias-alterable dielectric constant. By adjusting the bias on the EBG, the frequency response of the EBG can be moved over a preset range, thereby giving the overall antenna system the ability to be adjusted within this present range. Instead of a bias tunable dielectric, other EBG tuning mechanisms can be used, such as varactors or variable capacitors.

Figure 1:
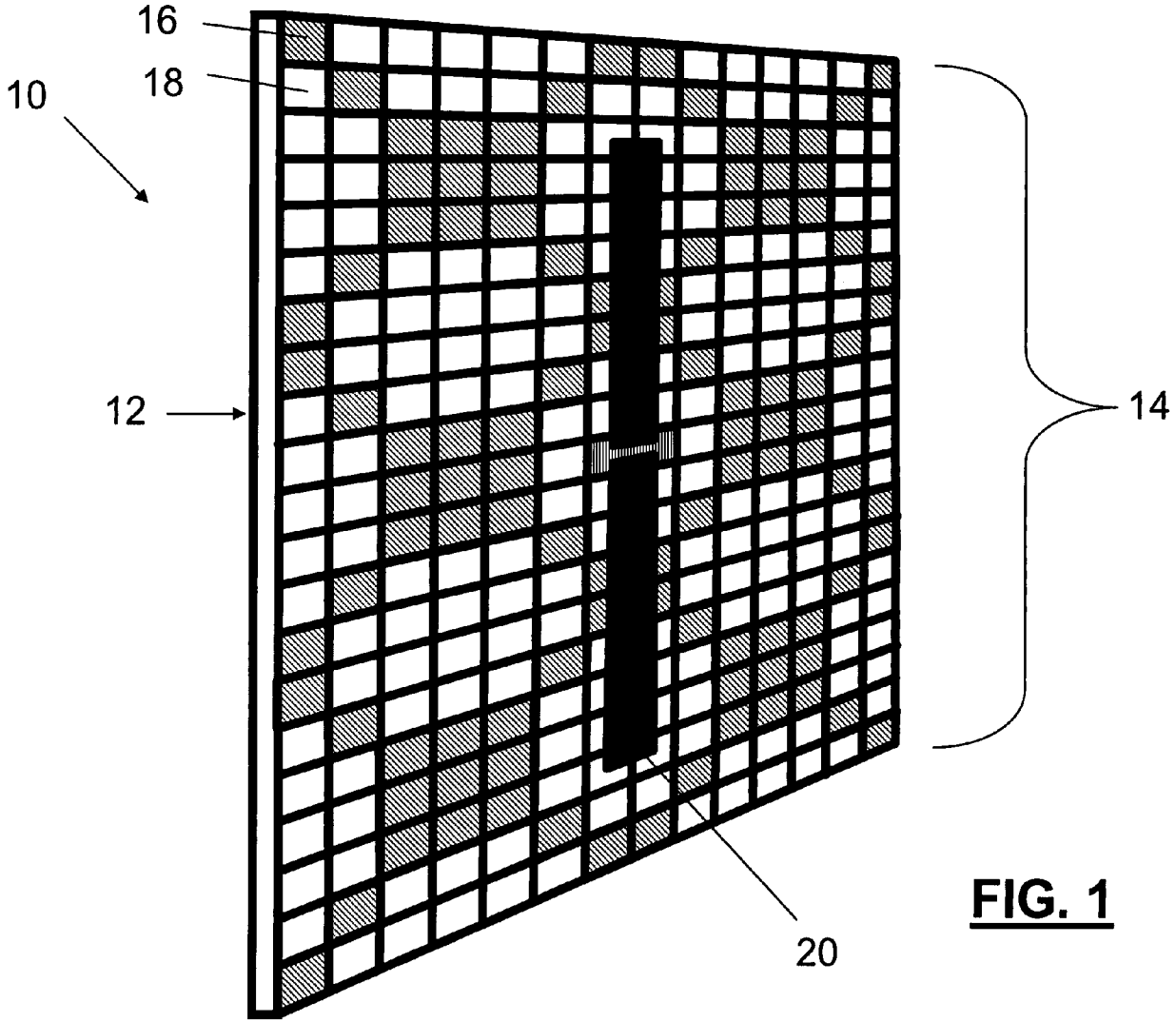
FIG. 1 is a pictorial representation of an EBG device with antenna according to one embodiment of the present invention.

FIG. 1 illustrates one embodiment of an antenna system 10 of the present invention. The antenna system 10 includes an EBG element 12. The EBG element includes a pattern or mosaic 14 formed of conductive areas or patches 16 and areas without the conductive areas or patches 18. The pattern 14 can be formed according to any number of different cell geometries. The geometry is preferably selected via an optimization method, such as a genetic algorithm. The specific geometries disclosed herein are merely illustrative as the present invention is in no way limited to a specific geometry. An antenna element 20 is also present on the EBG 20.

Figure 2:
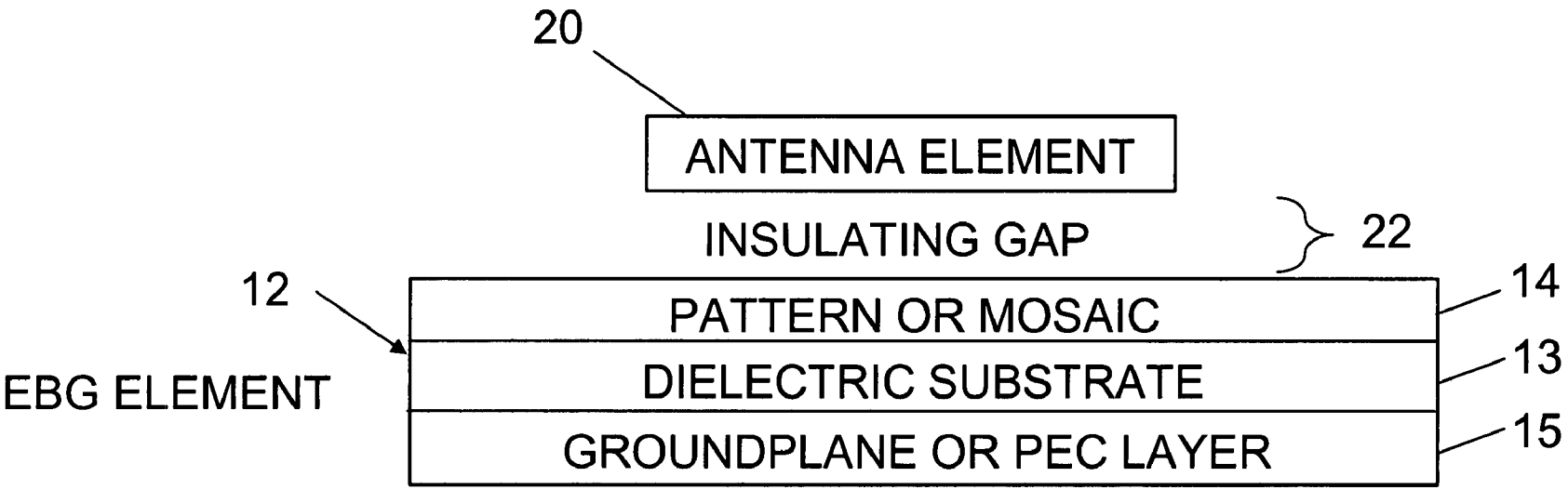
FIG. 2 is a block diagram illustrating one embodiment of an antenna system of the present invention.

FIG. 2 illustrates another view of one embodiment of the present invention. An antenna element 20 is placed proximate the EBG element 12. The antenna element 20 is separated from the EBG element 12 by an insulating gap 22, or is otherwise proximate the EBG element 12. The present invention contemplates that instead of being separated from the EBG element 12, the antenna 20 can contact the EBG element 12. The distance between the EBG element 12 and the antenna 20 can impart specific beam characteristics to the overall system. The present invention contemplates that this distance can be tailored for special effects. Also, in FIG. 2, the EBG element 12 includes a pattern or mosaic 14 on a dielectric substrate 13 which in turn overlays a groundplane or PEC layer 15. FIG. 2 merely illustrates one embodiment of the present invention and what is shown is not to scale.

Figure 3:
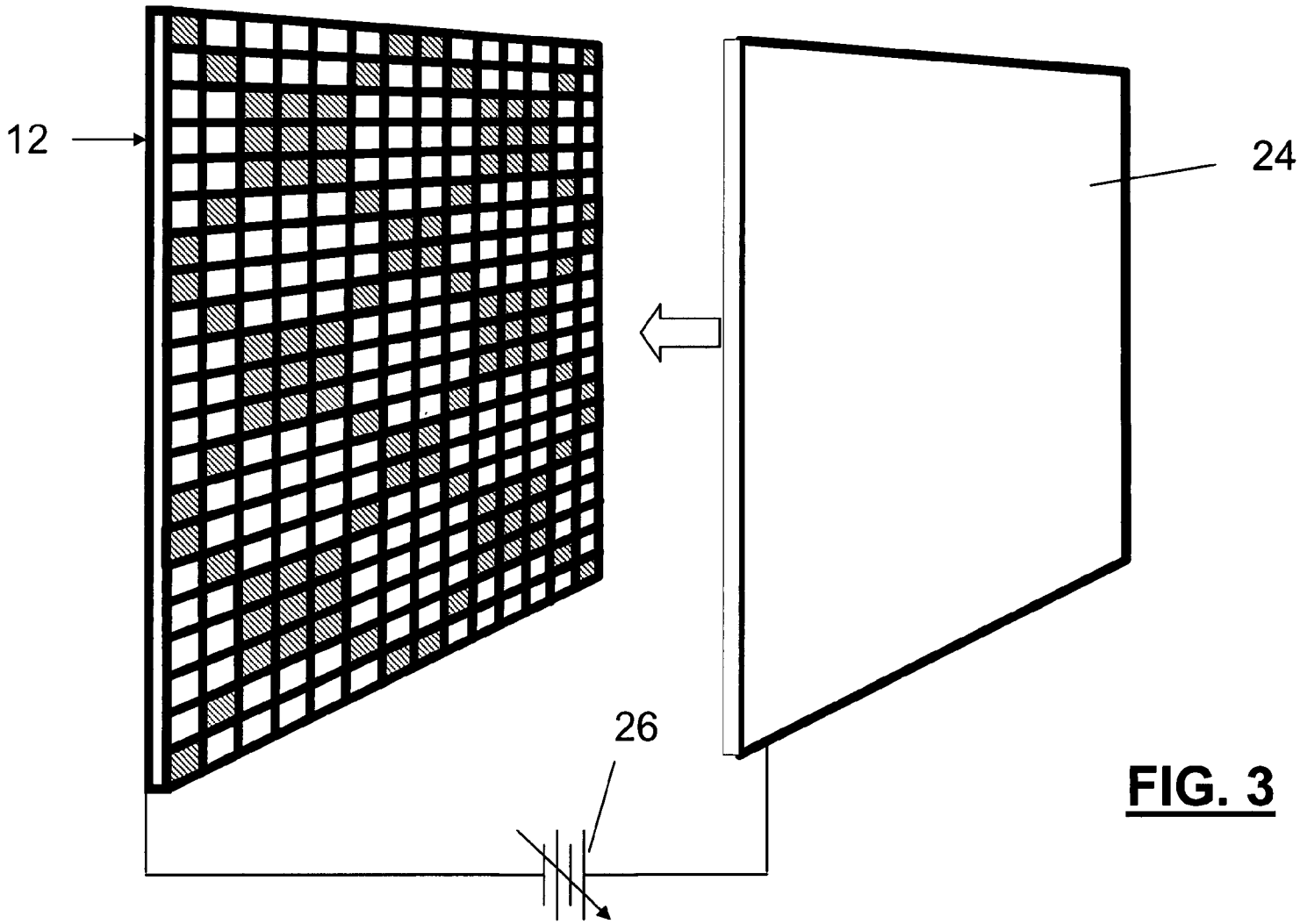
FIG. 3 is a pictorial representation of one embodiment of a bias alterable EBG device with a coating.

FIG. 3 illustrates another embodiment of the present invention. In the embodiment of FIG. 3, the EBG has a bias alterable dielectric. The use of a bias alterable dielectric results in the EBG being frequency agile. In FIG. 3, an EBG element 12 with a bias alterable dielectric is shown with a thin high resistivity coating or layer 24 that is placed over the mosaic of the EBG element 12. A DC voltage source 26 is electrically connected between a bottom PEC layer and a top mosaic layer. The presence of the high resistivity coating 24 allows for an even application of the bias to the dielectric but has a negligible effect on the RF signals when they pass through it. The use of the illustrated bias mechanism or other tuning mechanisms results in the EBG being tunable and frequency agile. The present invention contemplates that an EBG may be tunable through other mechanisms as well, the present invention is not to be limited to the specific manner in which the EBG is tuned or the specific mechanism used to tune the EBG.

FIG. 4 illustrates an overview of one embodiment of an EBG of the present invention. In FIG. 4, the reflection phase response is shown for a specific EBG design of the geometry shown by EBG 12. From the graph of the reflection phase response, it is sown that there is a center frequency of 258.9 MHz which is substantially lower than 1 GHz. The bandwidth is also shown on the graph by observing the transition of the phase from 90 degrees to −90 degrees. This region of interest of the reflection phase response is identified by reference numeral 30 and defines the bandwidth. As shown, the bandwidth is 3.1 MHz which is only about 1 percent of the center frequency making clear that the EBG 12 is for narrowband operation. The present invention contemplates a bandwidth of less than about 5 percent and preferably less than 1 percent or even 0.1% to be used.

Also in FIG. 4, the geometry of the EBG unit cell 12 is shown. The length and width of the EBG unit cell 12 are both 6.04 cm. The EBG unit cell 12 shown has a substrate dielectric constant of 100 which is substantially greater than conventional designs that attempt to approach free space permittivity. The thickness or height of the EBG 12 shown is only about 1.5 mm. To further describe the present invention, the design methodology and two specific designs are discussed. The present invention is in no way limited to these specific designs.

Figure 5A:
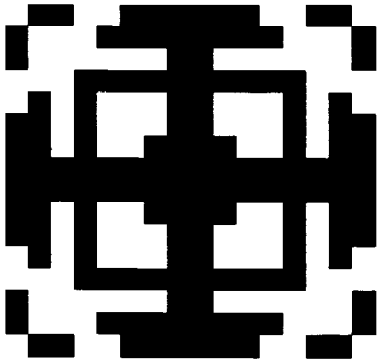
FIG. 5A illustrates cell geometry for one embodiment of an EBG device of the present invention.
Figure 5B:
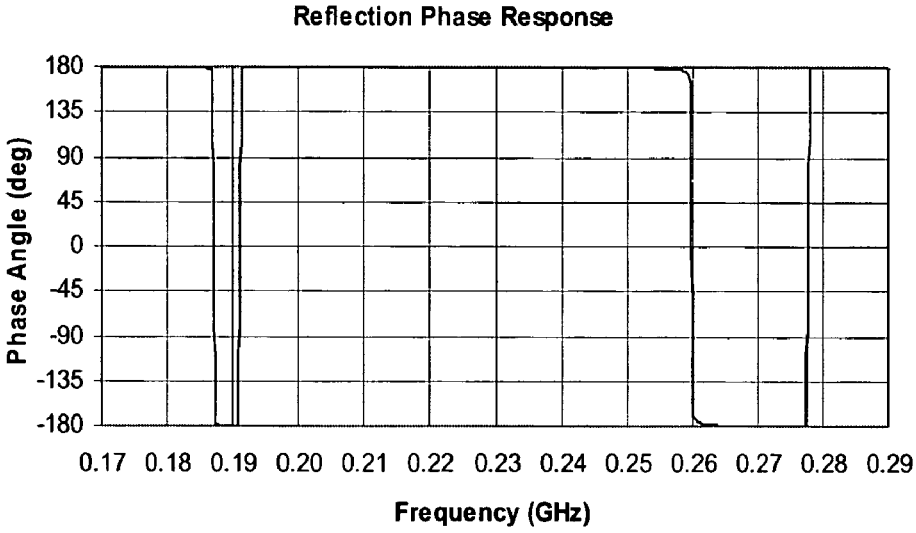
FIG. 5B is a graph of reflection phase response for one embodiment of an EBG device of the present invention.

First, in order to successfully design an AMC surface that can be tuned over a desired range of frequencies, it is necessary to optimize the design to have a specific channel bandwidth that is typically very narrow. The advantage to a narrow bandwidth is that the operating frequency can be very selective for a tunable design, which is a highly desirable feature in many communication system applications. Under these conditions, the AMC surface itself can also be made remarkably thin. The first design example that will be considered is presented in FIGS. 5A–5C. This AMC surface was optimized using a genetic algorithm for a center frequency at 260 MHz, with an instantaneous bandwidth of 180 kHz. Hence this EBG AMC design has a 0.07% bandwidth. A high-k dielectric constant with a value of $\in_r$=100−j 0.12 is assumed for this design. The unit cell size of the optimized structure is 13.48 cm and the thickness is only 0.575 mm (i.e., $\lambda/2000$). The unit cell size and reflection phase response are shown in FIGS. 5A–5B. As can be seen, this structure is actually dual-band, with a lower resonant frequency appearing at approximately 187 MHz.

Figure 6A:
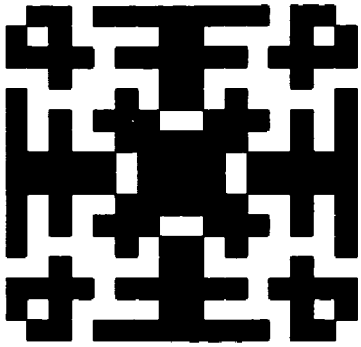
FIG. 6A illustrates cell geometry for one embodiment of an EBG device of the present invention.
Figure 6B:
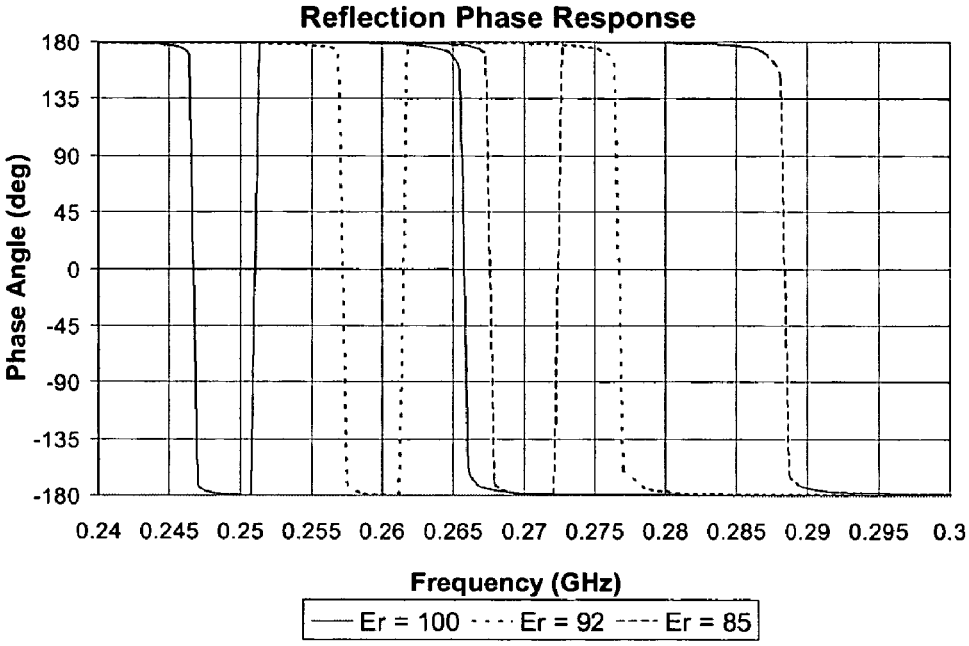
FIG. 6B is a graph of reflection phase response vs. dielectric constant for one embodiment of an EBG device of the present invention.

The next example, shown in FIGS. 6A–6B, is that of an optimized AMC for approximately the same resonant frequency. This design, however, was optimized to have its first resonance near 250 MHz as well as to exhibit minimum loss at that frequency. The unit cell geometry and reflection phase response are shown in FIGS. 6A–6B for three different values of the substrate dielectric constant. These three curves illustrate the advantage of the tunable ultra-thin design to operate anywhere between 247 and 267 MHz while maintaining a narrow 180 kHz instantaneous bandwidth, with a corresponding change in the dielectric constant from 100 to 85. The same loss tangent of 0.0012 was assumed in all three cases. This design has the same thickness as the previous design, and roughly the same percent bandwidth, with a smaller cell size of 8.5 cm.

The present invention is not to be limited to the exemplary embodiments described herein. For example, the unit cell thickness of about $\lambda/2000$ achieved is remarkable, but the present invention allows for greater thicknesses, including thicknesses between $\lambda/2000$ to about $\lambda/100$. Similarly, the present invention contemplates variations in the dielectric constants including dielectric constants well below 85, including dielectric constants less than about 40 or dielectric constants much higher than 100.

The present invention contemplates that numerous variations in the tuning mechanism used. When the tuning mechanism includes use of a bias-alterable dielectric, the present invention contemplates that any number of dielectrics can be used. Dielectrics comprising barium, strontium, and a titanium oxide have been used with mixed particle sizes in order to increase the density of the dielectric. The amount of tunability is related to the dielectric constant. For example, about a 3 percent tunability is associated with a dielectric having an $\in_r$ of 40 while a 30 percent tunability is associated with a dielectric having an $\in_r$ of 400.

A novel approach to the design of ultra-thin tunable EBG AMC surfaces for low-frequency applications has been introduced. This new design approach takes advantage of previous limitations of such structures by optimizing for a very narrow bandwidth. By actively tuning the AMC structure, a reasonable operating range can be achieved, but with a much-reduced thickness compared to conventional designs. Two examples were presented which demonstrate the ability to optimize the ultra-thin AMC structure via a genetic algorithm for a desired frequency response and bandwidth, as well as the ability to optimize for low loss over the intended tuning range.

The present invention contemplates variations in placing the antenna on or near the EBG. The present invention contemplates that because the distance between the EBG and antenna imparts specific beam characteristics to the overall system, this distance can be tailored for special effects. The present invention also contemplates that any of numerous fabrication methods can be used, for instance, the antenna element can be embedded into an insulating overcoat on the EBG thereby accomplishing the same basic stack-up or layering as shown herein.

The present invention contemplates numerous variations in the specific design, including the center frequency, bandwidth, EBG geometry, variations in the structure and configuration, use of particular materials, type of tuning mechanism, and other variations within the spirit and scope of the invention.

What is claimed is:

1. An antenna system comprising:

an antenna element;

an electromagnetic bandgap element proximate the antenna element;

wherein the electromagnetic bandgap element comprises a substrate with a metallic backing and a mosaic of conductive patches on a surface of the substrate optimized for narrow bandwidth operation thereby providing radiofrequency selectivity; and a thin high-resistivity coating on the mosaic for allowing an even application of a bias voltage between the mosaic and the substrate.

2. The antenna system of claim 1 wherein the electromagnetic bandgap element is tunable.

3. The antenna system of claim 2 wherein the electromagnetic bandgap element comprises a dielectric substrate with a bias-alterable dielectric constant.

4. The antenna system of claim 3 wherein the dielectric substrate has a dielectric constant of more than about 40.

5. The antenna system of claim 3 wherein the dielectric substrate has a dielectric constant of more than about 85.

6. The antenna system of claim 1 wherein the antenna system has an operation frequency of less than about 1 GHz.

7. The antenna system of claim 1 wherein the electromagnetic bandgap element is optimized for narrow bandwidth operation by use of a suitable cell geometry.

8. The antenna system of claim 1 wherein the electromagnetic bandgap element is of an artificial magnetic conducting (AMC) surface type.

9. The antenna system of claim 1 wherein the mosaic is patterned to provide for narrow bandwidth operation.

10. The antenna system of claim 9 wherein a genetic algorithm is used in patterning the mosaic to provide for narrow bandwidth operation.

11. The antenna system of claim 1 wherein an overall thickness of the electromagnetic bandgap element is less than about $\lambda/100$ wherein $\lambda$ is a wavelength of the antenna system.

12. The antenna system of claim 11 wherein the antenna system has an operating frequency ($c/\lambda$) of less than about 1 GigaHertz.

13. The antenna system of claim 1 wherein an overall thickness of the electromagnetic bandgap element is less than about $\lambda/1000$ wherein $\lambda$ is a wavelength of the antenna system.

14. The antenna system of claim 1 wherein an overall thickness of the electromagnetic bandgap element is less than about $\lambda/2000$ wherein $\lambda$ is a wavelength of the antenna system.

15. The antenna system of claim 1 wherein the narrow bandwidth is less than about 5 percent of a center frequency of the antenna system.

16. The antenna system of claim 1 wherein the narrow bandwidth is less than about 1 percent of a center frequency of the antenna system.

17. The antenna system of claim 1 wherein the narrow bandwidth is less than about 0.1 percent of a center frequency of the antenna system.

18. An artificial magnetic conducting (AMC) surface for use in an antenna system to provide a narrow bandwidth of operation and radio frequency selectivity, comprising:

a substrate of a dielectric material;

the substrate patterned with conductive patches to provide a unit cell geometry;

wherein the unit cell geometry is optimized for narrow bandwidth operation thereby providing radiofrequency selectivity; and a thin high-resistivity coating on the substrate patterned with conductive patches to allow application of a uniform bias voltage between the conductive patches and the substrate.

19. The AMC surface of claim 18 wherein the substrate is tunable.

20. The AMC surface of claim 18 wherein the narrow bandwidth of operation is less than about 5 percent of the operating frequency.

21. The AMC surface of claim 18 wherein the narrow bandwidth of operation is less than about 1 percent of the operating frequency.

22. The AMC surface of claim 18 wherein the narrow bandwidth of operation is less than about 0.1 percent of the operating frequency.

23. The AMC surface of claim 18 wherein the substrate has a dielectric constant of at least about 40.

24. The AMC surface of claim 18 wherein the substrate has a dielectric constant of at least about 85.

25. The AMC surface of claim 18 wherein the substrate has a thickness of less than about $\lambda/100$, wherein the operating frequency given by $c/\lambda$, is less than about 1 GHz.

26. The AMC surface of claim 18 wherein the substrate has a thickness of less than about $\lambda/1000$, wherein the operating frequency given by $c/\lambda$, is less than about 1 GHz.

27. An antenna system comprising:

an antenna element;

an electromagnetic bandgap element proximate the antenna element;

the electromagnetic bandgap element comprising a substrate of a dielectric material patterned with conductive patches overlaid with a thin high-resistive coating to provide a unit cell geometry suitable for narrow bandwidth operation of less than about 5 percent of an operating frequency to thereby provide radiofrequency selectivity;

the operating frequency less than about 1 GHz.

28. The antenna system of claim 27 wherein the electromagnetic bandgap element is tunable.

* * * * *